US009243758B2

(12) United States Patent
Pickard

(10) Patent No.: US 9,243,758 B2
(45) Date of Patent: Jan. 26, 2016

(54) COMPACT HEAT SINKS AND SOLID STATE LAMP INCORPORATING SAME

(75) Inventor: Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 449 days.

(21) Appl. No.: 12/582,206

(22) Filed: Oct. 20, 2009

(65) Prior Publication Data

US 2011/0090686 A1 Apr. 21, 2011

(51) Int. Cl.

| | |
|---|---|
| ***F21V 29/00*** | (2015.01) |
| ***F21K 99/00*** | (2010.01) |
| ***F21V 29/83*** | (2015.01) |
| *F21Y 101/02* | (2006.01) |
| *F21Y 111/00* | (2006.01) |
| *F21V 29/75* | (2015.01) |
| *F21V 29/76* | (2015.01) |
| *F21V 29/77* | (2015.01) |
| *F21V 29/85* | (2015.01) |

(52) U.S. Cl.

CPC ..... *F21K 9/135* (2013.01); *F21V 29/004* (2013.01); *F21V 29/83* (2015.01); *F21V 29/75* (2015.01); *F21V 29/763* (2015.01); *F21V 29/777* (2015.01); *F21V 29/86* (2015.01); *F21Y 2101/02* (2013.01); *F21Y 2111/005* (2013.01)

(58) Field of Classification Search

CPC ..... F21V 29/002; F21V 29/004; F21V 29/20; F21V 29/22; F21V 29/2206; F21V 29/2212; F21V 29/2243; F21V 29/255; F21K 9/00; F21K 9/10; F21K 9/13; F21K 9/135

USPC ..... 165/181, 182, 183; 362/555, 310, 362/221–223, 217.02, 217.1, 217.14, 218, 362/294, 373

See application file for complete search history.

(56) References Cited

U.S. PATENT DOCUMENTS

| | | | |
|---|---|---|---|
| 4,211,955 | A | 7/1980 | Ray |
| 5,087,212 | A | 2/1992 | Hanami |
| 5,191,512 | A | 3/1993 | Ogura et al. |
| 5,378,158 | A | 1/1995 | Owen et al. |
| 5,585,688 | A | 12/1996 | DeKleine |
| 5,850,126 | A | 12/1998 | Kanbar |
| 5,890,794 | A | 4/1999 | Abtahi et al. |
| 5,946,931 | A | 9/1999 | Lomax et al. |

(Continued)

FOREIGN PATENT DOCUMENTS

| | | |
|---|---|---|
| CN | 101666439 | 3/2010 |
| DE | 10 2007 040 444 | 3/2009 |

(Continued)

OTHER PUBLICATIONS

U.S. Appl. No. 13/089,807, filed Apr. 19, 2011, Pickard et al.

(Continued)

*Primary Examiner* — Thomas M Sember

(74) *Attorney, Agent, or Firm* — Burr & Brown, PLLC

(57) ABSTRACT

A solid state lamp with efficient heat sink arrangement. To provide adequate cooling utilizing a defined form factor, such as that of the A-lamp incandescent bulb, the interior volume is used more efficiently. As one example, a solid state lamp employs a heat sink with inward facing fins. Solid state light sources, such as light emitting diodes (LEDs), are mounted on the exterior of the heat sink. An air path for convective flow is established through the center of the lamp.

20 Claims, 10 Drawing Sheets

(56) References Cited

U.S. PATENT DOCUMENTS

| | | | | |
|---|---|---|---|---|
| 6,353,295 | B1 | 3/2002 | Sridhar et al. | |
| 6,499,860 | B2 | 12/2002 | Begemann | |
| 6,573,536 | B1 * | 6/2003 | Dry | 257/88 |
| 6,598,996 | B1 | 7/2003 | Lodhie | |
| 6,621,222 | B1 | 9/2003 | Hong | |
| 6,815,724 | B2 * | 11/2004 | Dry | 257/88 |
| 6,948,829 | B2 | 9/2005 | Verdes et al. | |
| 6,991,351 | B1 | 1/2006 | Petrick | |
| 7,031,155 | B2 | 4/2006 | Sauciuc et al. | |
| 7,064,498 | B2 | 6/2006 | Dowling et al. | |
| 7,144,135 | B2 | 12/2006 | Martin et al. | |
| 7,172,314 | B2 | 2/2007 | Currie et al. | |
| 7,213,940 | B1 | 5/2007 | Van De Ven et al. | |
| 7,245,495 | B2 | 7/2007 | Ouyang | |
| 7,253,446 | B2 | 8/2007 | Sakuma et al. | |
| 7,344,296 | B2 | 3/2008 | Matsui et al. | |
| 7,396,142 | B2 | 7/2008 | Laizure, Jr. et al. | |
| 7,434,964 | B1 | 10/2008 | Zheng | |
| 7,521,875 | B2 | 4/2009 | Maxik | |
| 7,524,089 | B2 * | 4/2009 | Park | 362/294 |
| 7,534,015 | B2 | 5/2009 | Xu et al. | |
| 7,556,869 | B2 | 7/2009 | Fukushima et al. | |
| 7,611,263 | B2 | 11/2009 | Huang et al. | |
| 7,661,854 | B1 | 2/2010 | Yang et al. | |
| 7,695,162 | B2 | 4/2010 | Zheng et al. | |
| 7,744,250 | B2 * | 6/2010 | Lee et al. | 362/294 |
| D626,267 | S | 10/2010 | Ng | |
| 7,857,488 | B2 | 12/2010 | Chen et al. | |
| 7,874,699 | B2 | 1/2011 | Liang | |
| D644,356 | S | 8/2011 | Pickard | |
| 8,066,414 | B2 | 11/2011 | Pabst et al. | |
| 8,104,919 | B2 | 1/2012 | Wung et al. | |
| 8,123,381 | B1 | 2/2012 | Wray | |
| 8,333,487 | B2 | 12/2012 | Mekhtarian | |
| 8,680,754 | B2 | 3/2014 | Premysler | |
| 8,783,910 | B2 | 7/2014 | Hua | |
| 2003/0063462 | A1 | 4/2003 | Shimizu et al. | |
| 2003/0117803 | A1 | 6/2003 | Chen | |
| 2005/0111234 | A1 | 5/2005 | Martin et al. | |
| 2005/0174780 | A1 | 8/2005 | Park | |
| 2005/0200289 | A1 | 9/2005 | Krichtafovitch | |
| 2006/0056113 | A1 | 3/2006 | Fukushima et al. | |
| 2006/0193130 | A1 | 8/2006 | Ishibashi | |
| 2007/0102033 | A1 | 5/2007 | Petrocy | |
| 2007/0230184 | A1 * | 10/2007 | Shuy | 362/294 |
| 2008/0055909 | A1 | 3/2008 | Li | |
| 2008/0253125 | A1 | 10/2008 | Kang et al. | |
| 2008/0316755 | A1 | 12/2008 | Zheng | |
| 2009/0040759 | A1 | 2/2009 | Zhang et al. | |
| 2009/0045933 | A1 | 2/2009 | Smith et al. | |
| 2009/0046464 | A1 | 2/2009 | Liu et al. | |
| 2009/0046473 | A1 | 2/2009 | Tsai et al. | |
| 2009/0059559 | A1 | 3/2009 | Pabst et al. | |
| 2009/0080187 | A1 | 3/2009 | Chou | |
| 2009/0080205 | A1 | 3/2009 | Chang et al. | |
| 2009/0160363 | A1 | 6/2009 | Negley | |
| 2009/0161356 | A1 | 6/2009 | Negley et al. | |
| 2009/0190312 | A1 | 7/2009 | Katayama et al. | |
| 2009/0195186 | A1 | 8/2009 | Guest et al. | |
| 2009/0245308 | A1 | 10/2009 | Yu et al. | |
| 2009/0261268 | A1 | 10/2009 | Schwiebert et al. | |
| 2009/0283779 | A1 | 11/2009 | Negley | |
| 2009/0288807 | A1 | 11/2009 | Yang et al. | |
| 2009/0310349 | A1 | 12/2009 | Xiang et al. | |
| 2010/0079984 | A1 | 4/2010 | Liu | |
| 2010/0165635 | A1 | 7/2010 | Chen | |
| 2010/0207502 | A1 | 8/2010 | Cao et al. | |
| 2010/0237760 | A1 | 9/2010 | Yang | |
| 2010/0265710 | A1 | 10/2010 | Xiao et al. | |
| 2010/0277069 | A1 | 11/2010 | Janik et al. | |
| 2010/0314985 | A1 | 12/2010 | Premysler | |
| 2010/0327725 | A1 | 12/2010 | Huang | |
| 2011/0156584 | A1 | 6/2011 | Kim | |
| 2011/0254423 | A1 | 10/2011 | Lee | |
| 2011/0297361 | A1 | 12/2011 | Carbone et al. | |
| 2012/0075854 | A1 | 3/2012 | Bartine | |
| 2012/0224374 | A1 | 9/2012 | Aliberti | |
| 2013/0208469 | A1 | 8/2013 | Progl | |
| 2014/0340870 | A1 | 11/2014 | Premysler | |

FOREIGN PATENT DOCUMENTS

| | | |
|---|---|---|
| EP | 2 239 493 | 10/2010 |
| JP | 2004-265626 | 9/2004 |
| JP | 2004296245 | * 10/2004 |
| KR | 20100003326 | 1/2010 |
| WO | 2009/073394 | 6/2009 |
| WO | 2009/091562 | 7/2009 |
| WO | 2009/157704 | 12/2009 |

OTHER PUBLICATIONS

U.S. Appl. No. 13/622,763, filed Sep. 19, 2012, Curt Progl.

Litetronics International LED Parfection, 2010, pp. 1-2.

Office Action from a corresponding European patent application bearing a mailing date of Mar. 26, 2015, 6 pages.

U.S. Appl. No. 12/411,905, filed Mar. 26, 2009, Van de Ven.

U.S. Appl. No. 12/476,356, filed Jun. 2, 2009.

Gernert, Nelson, *Active heat sink technology delivers added performance*, Electronic Products, Developments in active heat sink technology, pp. 1-4, no date.

ANSI C78.20/2003, Revision of C78.20/1995, American National Standard for electric lamps- A, G, PS and Similar Shapes with E26 Medium Screw Bases, (Oct. 2003), pp. 1-48.

Computer Cooling, Electronics Cooling, . . . , SynJet® Technology: Overview, www.noventix.com/technology, pp. 1-2, no date.

Cooligy's Active Microchannel Cooling System, www.frostytech.com/articleview.cfm, pp. 1-2, no date.

EE Times, Pin-fin heat sink integrates fan, www.eetimes.com/showarticle.jhtml, (Nov. 2009), pp. 1-2.

Indian origin scientists microchip-sized fan produces enough wind to cool a laptop, thaindian.com/ .../indian-origin-scientist . . . , Mar. 19, 2008, pp. 1-2.

Ionic Wind-Chillin' the PC, http://thefutureofthings.com/articles.p . . . , Jan. 2, 2007, pp. 1-5.

LED *PARFECTION*™, The Perfectly Designed Green Lighting Solution, http//www.litetronics.com/advertising/led-parfection-perfectly-designed.html, no date.

Philips, *Philips First to Submit to Department of Energy L PPIZE SM Competition with Development of LED Replacment for Common Household Bulb*, Philips L PRIZE SM Press Information, Sep. 24, 2009, pp. 1-3.

Coyne et al., *Giant Magnetoresistance: The Really Big Idea Behind a Very Tiny Tool*, Magnet Lab, www.magnet.fsu.edu/education/.../gmr/, pp. 1-4, no date.

Dan Schlitz, Dan Schlitz *of Thorrn Micro Technologies, Inc., Describes Innovative Micro-fan Technology*, National Science Foundation, Press Release 08-041-Video, nsf.gov/news/news_videos.jsp?cntn_id . . . , pp. 1, no date.

Nuventix, *Cooling LEDs is no longer a design obstacle*, Dual DLM Brochure, www.nuventix.com/led_cooling, pp. 1-4, no date.

Nuventix, *SynJet® PAR20 LED Cooler with Heat Sink*, Design Guide, Version 1.0, Jul. 2009, pp. 1-33.

Piezo Fans, *PiezoFans, LLC brings the latest piezoelectric technology to cooling applications*, http://www.piezofans.com/piezofans.php, pp. 1-2, no date.

Daniel Schlitz, *SBIR Phase I: Compact Heat Sink using Microscale Ion Driven Air Flow*, Science Storm, sciencestorm.com/award/0340270.html, pp. 1-3, no date.

Daniel Schlitz, *SBIR Phase II: Miniature Cooling System for Laptop Computers* , Science Storm, sciencestorm.com/award/0522126.html, pp. 1-3, no date.

Daniel Schlitz, *Silent, microchip sized 'fan' has no moving parts, yet produces enough wind to cool a laptop*, www.physorg.com/print125057974.html, Mar. 18, 2008 in Technology/Semiconductors, pp. 1-2.

(56) References Cited

OTHER PUBLICATIONS

THERMACORE, *Active Heat Sink Technology, AHST* , 2008, pp. 1.
Press Release 08-041, Tiny Torrents, National Science Foundation, nsf.gov/news/news_summm.jsp?cntn_id . . . , Mar. 17, 2008, pp. 1-3.
Jason Lombarg, *Toshiba to release highly-efficient LED bulbs*, http://www.ecnmag.com/news-Toshiba-LED-nulbs-100509.aspx, Oct. 5, 2009, pp. 1-2.

* cited by examiner

COMPACT HEAT SINKS AND SOLID STATE LAMP INCORPORATING SAME

BACKGROUND OF THE INVENTION

1. Technical Field

The invention is generally related to the field of lighting and more particularly to an improved solid state lamp which according to one aspect is adapted to be installed in a standard incandescent or fluorescent lamp socket, such as an Edison or GU-24 socket, for example.

2. Background of the Related Art

One of the largest categories of incandescent lamps in use today is the "A" lamp or Edison lamp widely employed in the United States. FIG. 1 shows an example of an A lamp incandescent bulb 100, a Philips 75 watt (W) 120 volt (V) A 19 medium screw (E26) base frosted incandescent, having part number PL234153. Bulb 100 has a screw base 102 for screwing into a 120V lighting fixture and sealed glass bulb 104. Bulb 100 also has a nominal height, h, of 4.1 inches and a nominal width, w, of 2.4 inches. The upper portion of bulb 100 is a hemisphere and the lower portion necks down to the screw base 100. In Europe and elsewhere other standard incandescent bulb mounting arrangements are employed. All such incandescent lamps are among the least energy efficient designs in use. The exemplary Philips bulb provides 1100 lumens using 75 watts of energy or 14.67 lumens/watt. As a result, many jurisdictions are mandating the phase out of such bulbs, and many consumers are beginning to phase out their use on their own.

Compact fluorescent lamps have been developed as retrofit replacements for the standard incandescent socket. While more efficient, these fluorescent lamps present their own issues, such as environmental concerns related to the mercury employed therein, and in some cases questions of reliability and lifetime.

FIG. 2 shows an example of a compact fluorescent bulb 200 employing a GU-24 lamp base 202. GU describes the pin shape and 24 the spacing of the pins which is 24 mm. Pins 204 and 206 in base 202 are inserted into a socket such as socket 210 of FIG. 2 and then twisted to lock bulb 200 in place. Power is connected to base 210 by electrical wiring 214.

A number of light emitting diode (LED) based A lamp replacement products have been introduced to the market. FIG. 3 illustrates an exploded view of a Topco Technologies Corp. LED lamp 300 having a lamp housing 310 comprising screw in plug 302, first cap 304, second cap 306, and lampshade 308. Lamp 300 also includes LED light source 320, heat sink 330, and control circuit 340. In another embodiment, a cooling fan is employed. Further details of lamp 300 are found in U.S. Patent Application Publication No. 2009/0046473A1 which is incorporated by reference herein in its entirety. Such products typically utilize some sort of upper hemisphere shaped body for emitting light at the top of the lamp. A lower or bottom portion of the lamp, the portion which transitions to the neck and screw base, is utilized for they mal management and to enclose the power supply.

SUMMARY OF THE INVENTION

Embodiments of the present inventive subject matter provide a solid state lamp that includes at least two solid state light emitters. The at least two solid state light emitters are disposed so that a primary axis of a light output of one of the at least two light emitters is in a direction in which the other of the at least two solid state light emitters directs no light. A heat sink is disposed between the at least to light emitters and defining a space between the at least two light emitters that is exposed to an environment for heat rejection.

In further embodiments, the solid state lamp includes least one lens disposed opposite the heat sink from at least one of the at least two solid state light emitters. The heat sink and the lens can define at least one cavity in which the solid state light emitters are disposed. A reflector can be provided in the at least one cavity. The solid state lamp may further include a diffuser associated with the at least one cavity to diffuse light from at least one of the solid state light emitters.

In some embodiments, the heat sink comprises a substantially hollow structure having fins disposed therein, the hollow portion of the heat sink being disposed opposite from the direction of light emission by the at least two solid state light emitters.

In additional embodiments, the lamp is contained within the envelope of an A lamp. The lamp may have a correlated color temperature of greater than 2500 K and less than 4500 K. The lamp may have a color rendering index of 90 or greater. The lamp may have a lumen output of about 600 lumens or greater. Furthermore, the lamp may have a light output of from about 0° to about 150° axially symmetric.

Some embodiments of the present inventive subject matter provide a solid state lamp that includes a lower portion having an electrical contact. An upper portion includes a heat sink comprising a plurality of outwardly facing mounting surfaces, each mounting face having a plurality of inwardly extending fins extending from a rear surface. The plurality of outwardly facing mounting surfaces and inwardly extending fins define a central opening extending from bottom to top of the heat sink. Light emitting diodes are supported by the exterior faces of the heat sink and at least one lens is provided associated with the light emitting diodes. A stand connects the lower portion and the upper portion in a spaced relationship so as to allow air flow between the upper portion and the lower portion.

In particular embodiments, the electrical contact comprises one of an Edison screw contact, a GU24 contact or a bayonet contact. The upper portion may have a form factor substantially corresponding to an A lamp. The lamp may provide at least about 600 lumens while passively dissipating at least about 6 W of heat. Driver circuitry may also be disposed within the lower portion to provide a self-ballasted lamp.

In still further embodiments of the present inventive subject matter, a heat sink for a solid state lighting device is provided. The heat sink includes a main body section that defines a central opening extending longitudinally along the main body section. The main body section has at least one outwardly facing mounting surface configured to mount a solid state light emitter. At least one inwardly extending fin extends from the main body section into the central opening.

In further embodiments, the at least one outwardly facing mounting surface comprises a plurality of outwardly facing mounting surfaces. The at least on inwardly extending fin may comprise a plurality of inwardly extending fins. Furthermore, an outer profile of the heat sink may be small enough to fit within the profile of an A lamp.

These and other advantages and aspects of the present invention will be apparent from the drawings and Detailed Description which follow.

DETAILED DESCRIPTION

Figure 1:
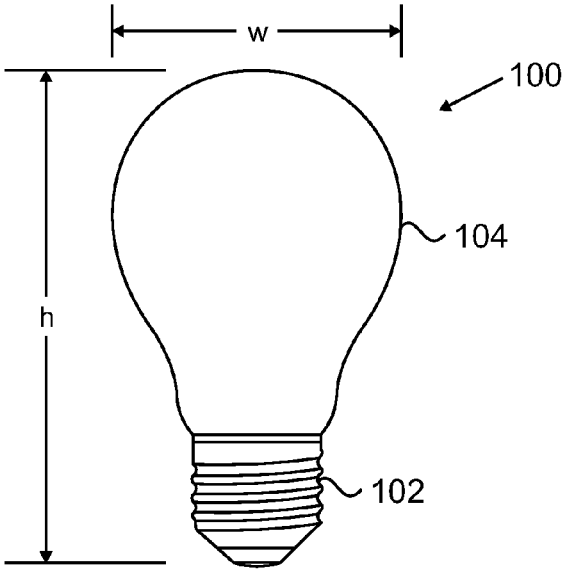
FIG. 1 (RELATED ART)
FIG. 1 shows an example of an incandescent light bulb.
Figure 2:
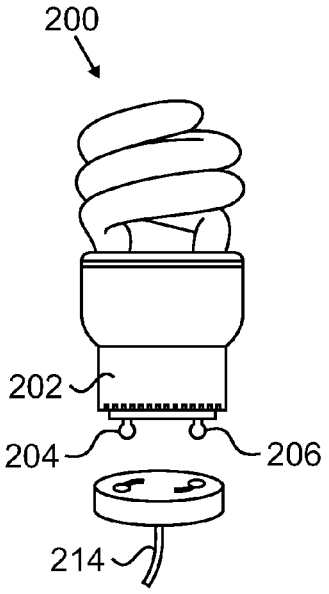
FIG. 2 (RELATED ART)
FIG. 2 shows an example of a compact fluorescent light bulb.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein.

Figure 3:
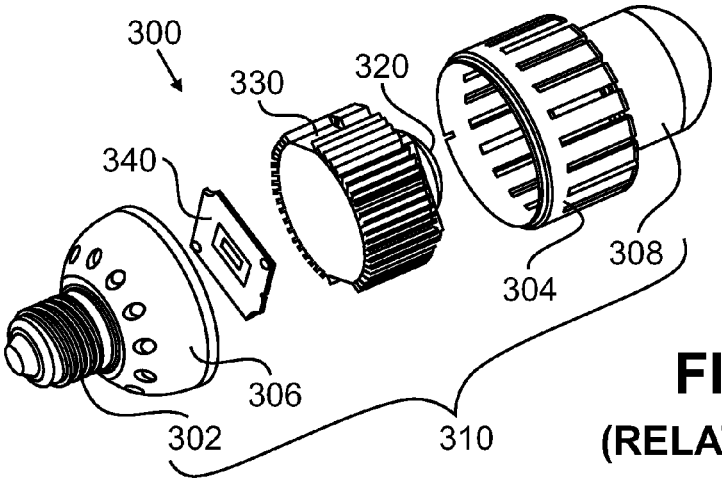
FIG. 3 (RELATED ART)
FIG. 3 shows an example of an LED lamp.

A problem with passive LED approaches like the one shown in FIG. 3 is that in order to generate a comparable amount of light as the Philips 75 W incandescent lamp, for example, the most efficient LEDs still require approximately 6-10 W of thermal dissipation capacity. The amount of surface area available within the lower portion of an A-lamp like retrofit structure cannot passively dissipate this amount of heat without an unacceptable temperature rise, which in turn raises the LED junction temperature reducing LED lifetime and performance. Another alternative is to limit the lumen output so that less heat needs to be dissipated, but such approaches may result in insufficiently bright lamps that are unacceptable to many consumers. A further alternative is to employ an active cooling solution, for example, such as a fan to move air across the heat sink in order to lower the temperature of the heat sink and the LED junction temperature to an acceptable level. However, such active cooling approaches present their own issues, such as cost, weight, noise, ease of manufacture and possible negative impact on the form factor of the lamp, for example.

Among its several aspects, the present invention recognizes it will be highly desirable to replace the incandescent A-lamp with a solid state alternative in order to reduce overall energy consumption and minimize environmental impact while not employing an active cooling approach, such as a fan, and while maintaining a reasonable conformance to the A-lamp form factor. The size and volume constraints of the A-lamp make a solid state design particularly challenging with an important constraint being the amount of volume available for passive thermal management. The present invention provides unique approaches to such management.

Among its several aspects, the present invention addresses such problems by turning the fins of the heat sink inwards rather than outwards. Additionally, the LEDs used as a solid state source are mounted towards the exterior of the lamp as discussed in further detail below. By using the volume of the A-lamp shape more fully and effectively, additional heat sink surface area is provided, more effective air cooling occurs, and dissipation of higher wattages with acceptable LED junction temperatures are achieved than by arrangements in which the heat sink fins are fit into the narrow neck section of the A-lamp. While the invention is illustrated mainly in the context of an A-lamp replacement, it will be recognized that its teachings are more generally applicable to other lamp replacements, as well as new solid state lamp designs.

In particular, while certain embodiments of the present invention are described with reference to an LED based solid state lamp having a form factor making it suitable as a retrofit replacement for an incandescent A lamp, it will be recognized that the teachings are more generally applicable to other types of lamps, mounting arrangements and shapes. As an example, while an Edison screw type connector is mainly discussed, the teachings are applicable to GU-24, bayonet, or other present or future connectors. Similarly, the teachings are applicable to replacements for bulbs having other form factors, as well as, new lamp designs. While four planar mounting faces are shown, other numbers and shapes or a mix of shapes may be employed.

As used herein, the term "A lamp" refers to an omnidirectional light source that fits within one of the ANSI standard dimensions designated "A", such as A19, A21, etc. as described, for example, in ANSI C78.20-2003 or other such standards. Embodiments of the present inventive subject matter may also be applicable to other conventional lamp sizes, such as G and PS lamps or non-conventional lamp sizes.

In some instances, color/light output from a solid state light emitter, or from a combination of solid state light emitters, or from an entire lighting device, can be analyzed after the solid state light emitters reach thermal equilibrium (e.g., while operating, the temperature of each of the solid state light emitters will not vary substantially (e.g., more than 2 degrees C.) without a change in ambient or operating conditions). In such a case, the color/light analysis is said to be "with the solid state light emitters at thermal equilibrium." As will be appreciated by those of skill in the art, the determination that a light emitter has reached thermal equilibrium may be made in many different ways. For example, the voltage across the light emitters may be measured. Thermal equilibrium may be reached when the voltage has stabilized. Similarly, when the wavelength output of the light emitters has stabilized, the light emitters will be at thermal equilibrium. Also, for phosphor converted LEDs, when the peak wavelengths of the phosphor component and the LED component have stabilized, the LEDs will be at thermal equilibrium.

In some instances, color/light output can be analyzed while the solid state light emitters (or the entire lighting device) are at ambient temperature, e.g., substantially immediately after the light emitter (or light emitters, or the entire lighting device) is illuminated. The expression "at ambient temperature", as used herein, means that the light emitter(s) is within 2 degrees C. of the ambient temperature. As will be appreciated by those of skill in the art, the "ambient temperature" measurement may be taken by measuring the light output of the device in the first few milliseconds or microseconds after the device is energized.

In light of the above discussion, in some embodiments, light output characteristics, such as lumen output, chromaticity (correlated color temperature (CCT)) and/or color rendering index (CRI) are measured with the solid state light emitters, such as LEDs, at thermal equilibrium. In other embodiments, light output characteristics, such as lumens, CCT and/or CRI are measured with the solid state light emitters at ambient temperature. Accordingly, references to lumen output, CCT or CRI describe some embodiments where the light characteristics are measured with the solid state light emitters at thermal equilibrium and other embodiments where the light characteristics are measured with the solid state light emitters at ambient.

Figure 4:
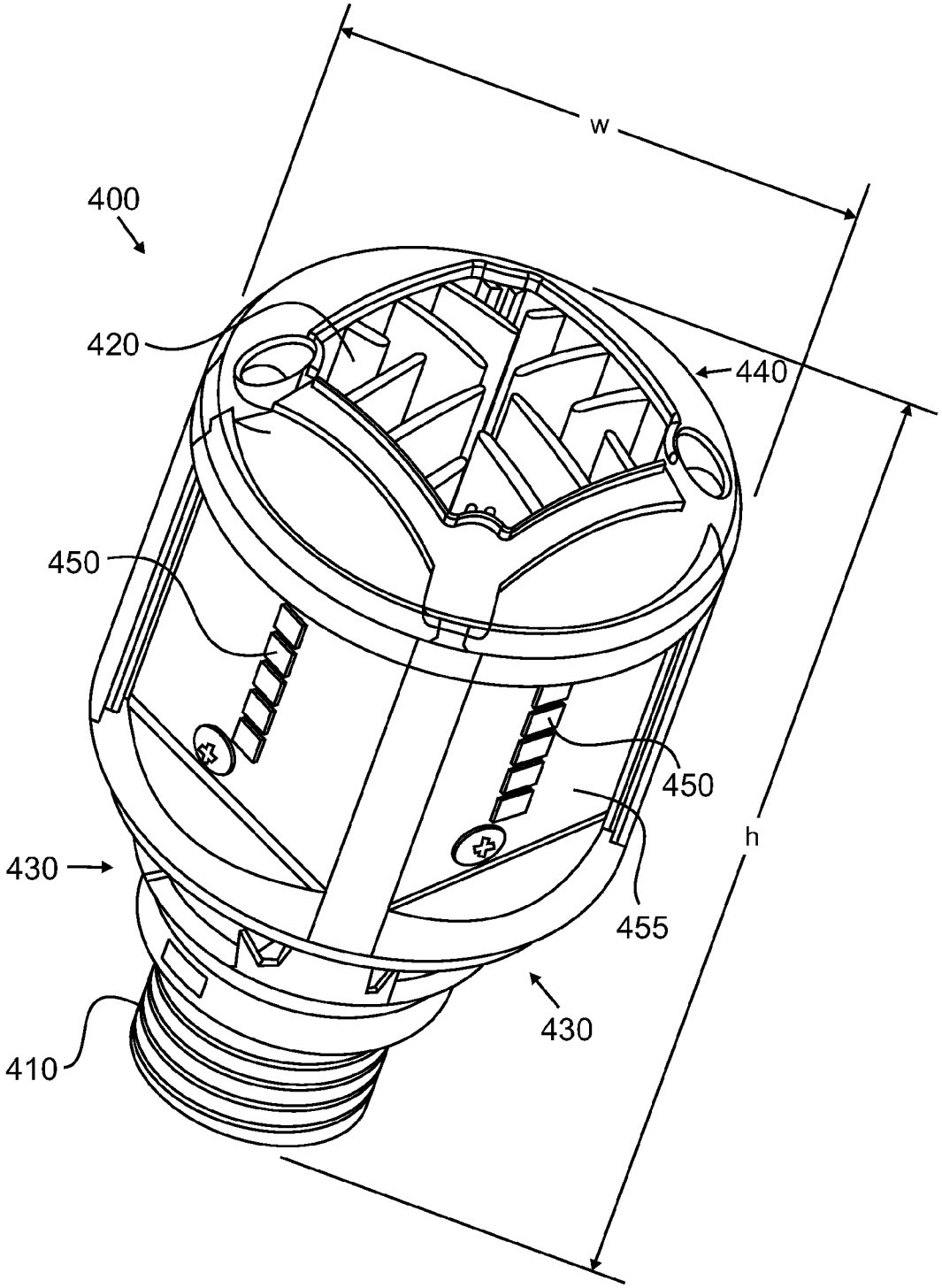
FIG. 4 is a top perspective view of a solid state lamp in accordance with the present invention.
Figure 5:
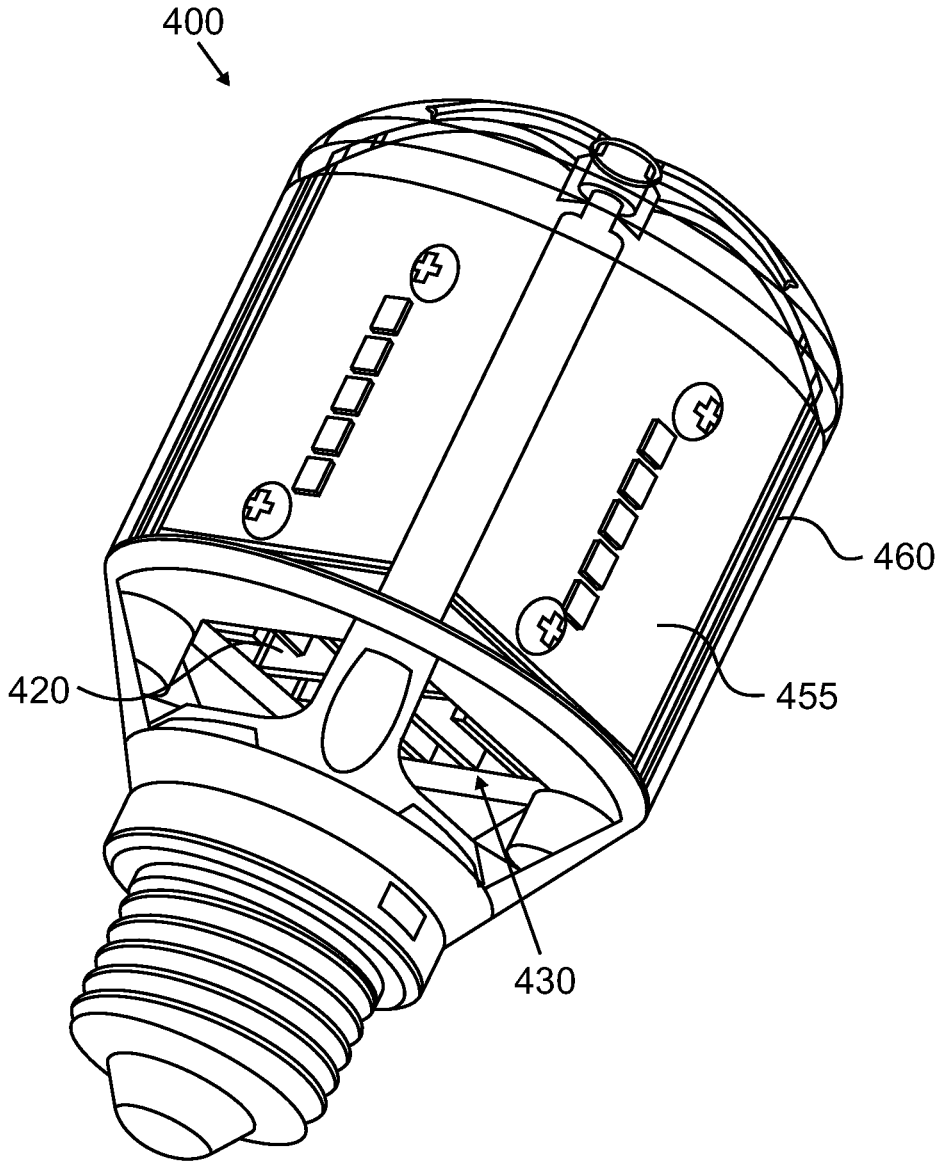
FIG. 5 is a bottom perspective of the compact solid state lamp of FIG. 4.

FIG. 4 shows a top perspective view of a solid state lamp 400 in accordance with some embodiments of the present inventive subject matter. FIG. 5 shows a bottom perspective of the lamp 400. Lamp 400 has a standard screw type connector 410, height, h, of approximately 108.93 millimeters (mm) or 4.3 in and a width, w, of approximately 58 mm or 2.3 in. As such, it has a form factor that falls within an ANSI standard A19 medium screw base lamp illustrated in Figure C.78-20-211 which has a maximum height of 112.7 mm and a maximum width of 69.5 mm. The illustrative dimensions of lamp 400 fall well within these ranges. It will be recognized that these illustrative dimensions may be varied to meet the demands of a wide variety of lighting applications. For example, larger dimensions could be provided for higher output lamps, such as an A21 lamp or smaller dimensions could be provided for lower output lamps, such as an A15 lamp.

From FIGS. 4 and 5, it will be seen that heat sink 420 has a plurality of inward facing fins that extend into a cavity defined by a body section of the heat sink. The surface area provided by these inward facing fins enables the dissipation of higher wattages with acceptable temperatures as compared with existing solid state designs which force the heat sink fins to the narrow bottom section of the A-lamp. A bottom opening 430 and a top opening 440 allow efficient convection air cooling of the lamp 400 as discussed further below. Rather than being bunched centrally, LEDs 450 are mounted on outward facing external mounting surfaces of the heat sink 420. The physical dispersal of LEDs 450 serves to disperse the heat, which they generate, and may reduce thermal coupling between LEDs and/or between subsets of the LEDs.

As seen in FIGS. 4 and 5, LEDs 450 are disposed so that a primary axis of a light output of one set of the LEDs 450 is in a direction in which the other sets of LEDs 450 do not direct light. In other words, the LEDs 450 are configured to provide 360° of light despite each set of LEDs only producing about 180° of light.

The heat sink 420 may be made of any suitable thermally conductive material. Examples of suitable thermally conductive materials include extruded aluminum, forged aluminum, copper, thermally conductive plastics or the like. As used herein, a thermally conductive material refers to a material that has a thermal conductivity greater than air. In some embodiments, the heat sink 420 is made of a material with a thermal conductivity of at least about 1 W/(m K). In other embodiments, the heat sink 420 is made of a material with a thermal conductivity of at least about 10 W/(m K). In still further embodiments, the heat sink 420 is made of a material with a thermal conductivity of at least about 100 W/(m K).

Additionally, side lenses 460 are provided to define a mixing cavity 455 in which the LEDs 450 are mounted. The mixing cavity 455 may act as a mixing chamber to combine light from the LEDs 450 disposed within the mixing cavity 455. The side lenses 460 may be transparent or diffusive. In some embodiments, a diffuser film 462 is provided between the LEDs 450 and the side tens 460. Diffuser films are available from Fusion Optix of Woburn, Mass., BrightView Technologies of Morrisville, N.C., Luminit of Torrance, Calif. or other diffuser film manufacturers. Alternatively or additionally, the side lenses 460 may be diffusive, for example, by incorporating scattering material within the side lenses, patterning a diffusion structure on the side lenses or providing a diffusive film disposed within the mixing cavity 455 or on the lens 460. Diffuser structures having diffusive material within the lens may also be utilized. Diffusive materials that may be molded to form a desired lens shape and incorporate a diffuser are available from Bayer Material Science or SABIC. The mixing chamber may be lined with a reflector, such as the reflector plate 452 or may be made reflective itself. The reflective interior of the cavity 455 may be diffuse to enhance mixing. Diffuse reflector materials are available from Furukawa Industries and Dupont Nonwovens. By providing a mixing chamber that utilizes refractive and reflective mixing, the spatial separation between the LEDs 450 and the side lens 460 required to mix the light output of the LEDs 450 may be sufficiently large to allow for near field mixing of the light. Optionally, the LEDs 450 may be obscured from view by a diffuser structure as described above such that the LEDs 450 do not appear as point sources when the lamp 400 is illuminated. In particular embodiments, the mixing chamber provides near field mixing of the light output of the LEDs 450.

Figure 6:
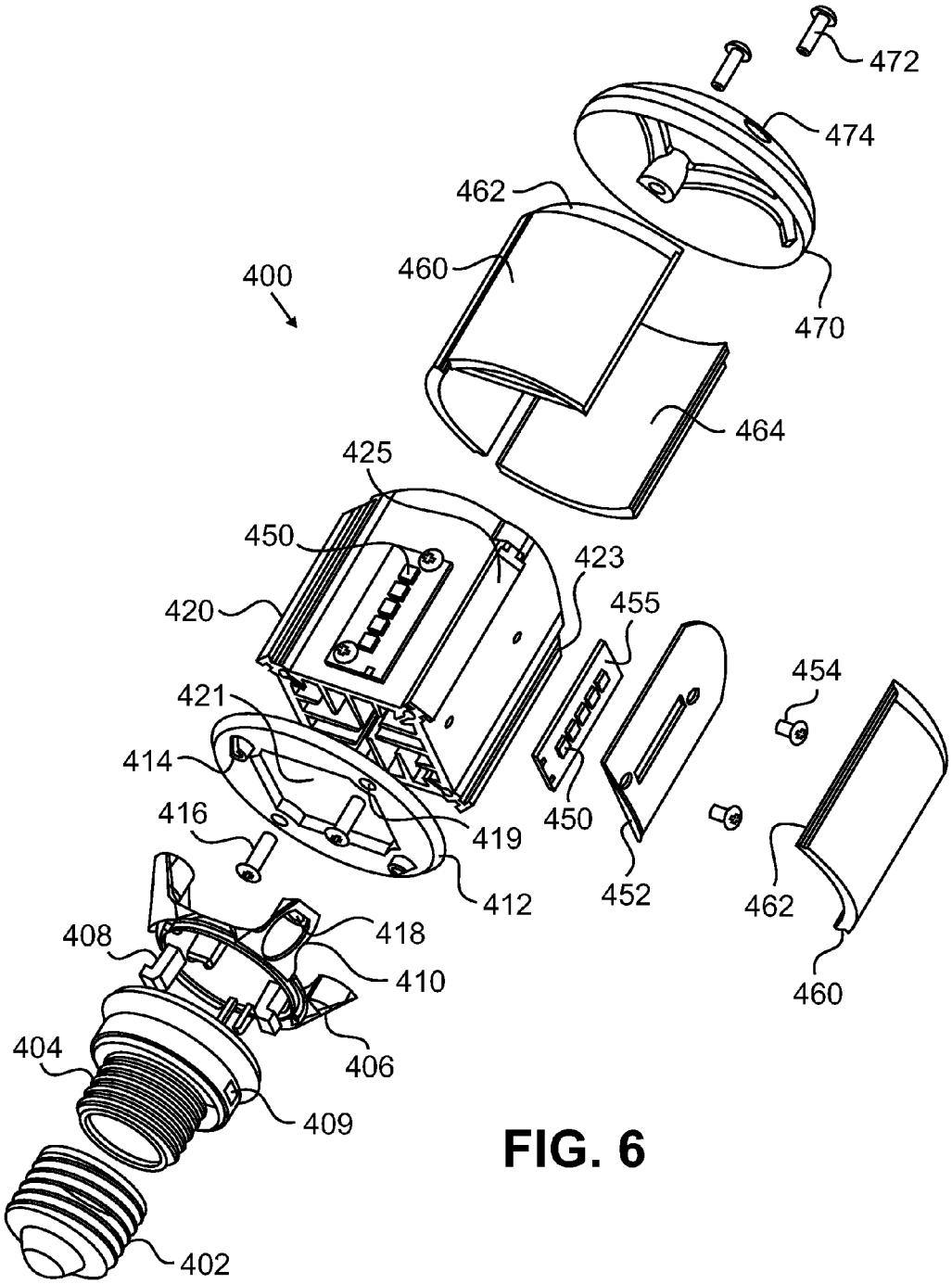
FIG. 6 is an exploded view of the compact solid state lamp of FIG. 4.

FIG. 6 shows an exploded view of the lamp 400 which comprises a screw shell 402 which fits onto a lower device housing 404. The lower device housing 404 houses drive circuitry for converting standard power, such as 120V line power provided in the United States to a voltage and current suitable for driving solid state lighting sources, such as LEDs. The particular configuration of the drive circuitry will depend on the configuration of the LEDs. In some embodiments, the drive circuitry comprises a power supply and drive controller that allows for separate control of at least two strings of LEDs, and in some embodiments, at least three strings of LEDs. Providing separate drive control can allow for adjusting string currents to tune the color point of the LEDs combined light output as described, for example, in commonly assigned United States Patent Publication No. 2009/0160363 entitled "Solid State Lighting Devices and Methods of Manufacturing the Same," the disclosure of which is incorporated herein as if set forth in its entirety. Alternatively, the drive circuitry may comprise a power supply and single string LED controller. Such an arrangement may reduce cost and size of the drive circuitry. In either case, the drive circuitry may also provide power factor correction. Thus, in some embodiments, lamp 400 may have a power factor of greater than 0.7 and in further embodiments a power factor of greater than 0.9. In some embodiments, the lamp 400 has a power factor of greater than 0.5. Such embodiments may not require power factor correction and, therefore, may be less costly and smaller in size. Additionally, the drive circuitry may provide for dimming of the lamp 400.

Lower device housing 404 also supports lower stand 406 which has four legs 408 which fit into housing 404 and which may snap into or interlock with a cutout or locking slot, such as cutout 409. Lower stand 406 also has four support and spacing arms 410 which support a lower base 412 above and spaced from the lower housing 404. This spacing helps allow for free airflow and helps provide thermal isolation between the drive circuitry and the LEDs. The lower device housing 404, lower stand 406 and/or lower base 412 may be made of a thermoplastic, a polycarbonate, a ceramic, aluminum or other metal or another material may be utilized depending upon cost and design constraints. For example, the lower housing 404 may be made of a non-conductive thermoplastic to provide isolation of drive circuitry contained within the lower housing 404. The lower stand 406 may be made of an injection molded thermoplastic. The lower base 412 may be made of a thermoplastic. Alternatively, if the lower base 412 is to provide additional heat dissipation, the lower base 412 may be made of a metal, such as aluminum and thermally coupled to the heat sink 420, for example, using a thermal interface gasket.

Two extending guide members 414 align the lower base with and seat in two of the mounting arms 410. Two lower base screws 416 pass through respective openings 418 in arms 410 and openings 419 in lower base 412 to connectively mount a base portion of the lamp 400 comprising screw shell 402, lower driver housing 404, lower stand 406, and lower base 412 to an upper portion of lamp 400. Lower base 412 also comprises a large central opening 421. In conjunction with the spacing of the heat sink away from and above the power supply enclosure body, opening 421 allows air to freely flow through the opening 421 and the heat sink 420, as well as through top opening 440.

The upper portion of lamp 400 comprises the heat sink 420, four LED boards 450, reflector plates 452, LED board mounting screws 454, side lenses 460, top lens 470, and top lens screws 472. As described above, the reflector plates 452 and side lenses 460 may provide a mixing chamber in the cavity 455 in which the LEDs 450 are provided.

While not illustrated in the figures, to the extent that two components are to be thermally coupled together, thermal interface materials may also be provided. For example, at the interface between the circuit board on which the LEDs 450 are mounted and the heat sink 420, a thermal interface gasket or thermal grease may be used to improve the thermal connection between the two components.

As noted above, lower screws 416 attach the bottom portion of lamp 400 to the upper portion of lamp 400. As shown, they mate with the heat sink 420. The reflector plates 452 and screws 454 attach an LED board 455 on each of the four faces of the heat sink 420. Five LEDs 450 are shown on each board 455, and it is presently preferred that these LEDs be XPE-style LEDs from Cree, Incorporated. While these LEDs are presently preferred, it will be recognized that other styles and brands may be suitable employed. The number of LEDs 450 can be changed by changing the number of LED boards 455, as well as, by changing the number of LEDs 450 on the LED boards 455. In some embodiments, the number and types of LEDs are selected so that lamp 400 provides at least 600 lumens, in other embodiments, at least 750 lumens and in still further embodiments, at least 900 lumens. In other embodiments, the numbers and types of LEDs 450 are selected so that lamp 400 provides at least 1100 lumens. In some embodiments, the lumens are initial lumens (i.e. not after substantial lumen depreciation has occurred).

In particular embodiments, the lamp 400 provides light having a correlated color temperature (CCT) of between about 2500K and about 4000K. In some embodiments, the CCT may be as defined in the Energy Star Requirements for Solid State Luminaires, Version 1.1, promulgated by the United States Department of Energy. In particular embodiments, the CCT of the lamp 400 of about 2700K and falls within a rectangle bounded by the points having x, y coordinates of 0.4813, 0.4319; 0.4562, 0.4260; 0.4373, 0.3893; and 0.4593, 0.3944 of the 1931 CIE Chromaticity Diagram. In further embodiments, the CCT of the lamp 400 of about 3000K and falls within a rectangle bounded by the points having x, y coordinates of 0.4562, 0.4260; 0.4299, 0.4165; 0.4147, 0.3814; and 0.4373, 0.3893 of the 1931 CIE Chromaticity Diagram. In some embodiments, the CCT of the lamp 400 of about 3500K and falls within a rectangle bounded by the points having x, y coordinates of 0.4299, 0.4165; 0.3996, 0.4015; 0.3889, 0.3690; and 0.4147, 0.3814 of the 1931 CIE Chromaticity Diagram. In some embodiments, the CCT of the lamp 400 of about 4000K and falls within a rectangle bounded by the points having x, y coordinates of 0.4006, 0.4044; 0.3736, 0.3874; 0.3670, 0.3578; and 0.3898, 0.3716 of the 1931 CIE Chromaticity Diagram.

The LEDs 450 may be provided in a linear arrangement as shown in FIG. 6 or may be provided in other configurations. For example, a roughly circular, triangular or square array or even a single packaged device having one or more LEDs, such as an MC device from Cree, Inc., or as an array as described in commonly assigned U.S. patent application Ser. No. 12/475,261 (now U.S. Patent Publication No. 2009/0283779), entitled "Light Source with Near Field Mixing" filed May 29, 2009, the disclosure of which is incorporated herein as if set forth in its entirety, may be utilized. In a particular embodiment, 5 LEDs are provided with 3 blue shifted yellow (BSY) LEDs and 2 red LEDs where the LEDs are disposed alternating BSY and red LEDs. In some embodiments, the BSY LED has a color point that falls within a rectangle on the 1931 CIE Chromaticity diagram bounded by the x, y coordinates of 0.3920, 0.5164; 0.4219, 0.4960; 0.3496, 0.3675; and 0.3166, 0.3722. In particular embodiments, the BSY LED has a color point that combines with a red LED to provide white light having a high CRI as described in U.S. Pat. No. 7,213,940, entitled "Lighting Device and Lighting Method," the disclosure of which is incorporated herein by reference as if set forth in its entirety.

Side lenses 460 have edges which snap or slidably fit into corresponding grooves 423 of corner mounts 425 of the heat sink 420. Top lens or cap 470 fits over the top edges 462 of side lenses 460 and top screws 472 pass through mounting openings 474 in the top lens 470 and mate with the heat sink 420. The embodiment shown may suitably employ extruded lenses with an injection molded top cap, but alternatively a single injection molded piece or east component could replace these multiple pieces. The assembled lamp 400 is shown in FIGS. 4 and 5.

The optical design and geometry of the reflector plates 452, side lenses 460 and top lens or cap 470 may be adapted to provide light output over greater than a 180° hemisphere, for example, over a zone between 0° and 150° axially symmetric where the 180° hemisphere would be a zone between 0° and 90° axially symmetric, by several different approaches. One approach is to utilize phosphor converted warm white LEDs with a diffuser film or a layer at the lens interface to provide a wide angular dispersion of light and mix the light from the warm white LEDs. Another approach utilizes BSY and red LEDs as described in U.S. Pat. No. 7,213,940, in combination with a diffuser film or layer to provide warm white light across a wide angular distribution. A third approach uses blue LEDs driving a remote phosphor layer layered on and/or molded into the lens and/or provided as a separate structure from the lens. The remote phosphor generates light that appears white, either alone or in combination with the blue light from the LEDs. Furthermore, the phosphor layer may provide a wide angle of dispersion for the light as well as diffusing any blue light that passes through the phosphor layer. The phosphor layer may be a single or multiple phosphor layers combined. For example, a yellow phosphor, such as YAG or BOSE may be combined with a red phosphor to result in warm white light (e.g., a CCT of less than 4000K). Additionally, multiple remote phosphors, such as described in commonly assigned U.S. patent application Ser. No. 12/476,356 (now U.S. Patent Publication No. 2010/0301360), "Lighting Devices With Discrete Lumiphor-Bearing Regions On Remote Surfaces Thereof" filed Jun. 2, 2009, the disclosure of which is incorporated herein as if set forth in its entirety, either coated onto or molded into the lenses and cap could be utilized to provide warm white light across a wide angular distribution. An additional approach utilizes blue and red LEDs to drive a phosphor layer coated onto, molded into and/or provided separate from the lenses and cap to provide warm white light across a wide angular distribution.

The spacing of LEDs along most of the length of the upper portion of lamp 400 as shown in FIGS. 4 and 5, for example, provides for light emission along almost the entire body of the lamp. When a lamp, such as the lamp 400, is used in a decorative setting with a lamp shade or decorative glass fitting undesirable shadows or hot spots may be advantageously reduced or avoided.

Figure 7A:
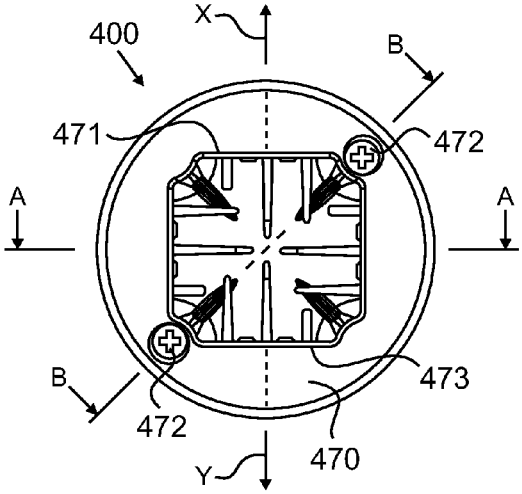
FIGS. 7A, 7B and 7C are bottom, side and top views of the compact solid state lamp of FIG. 4, respectively.
Figure 7B:
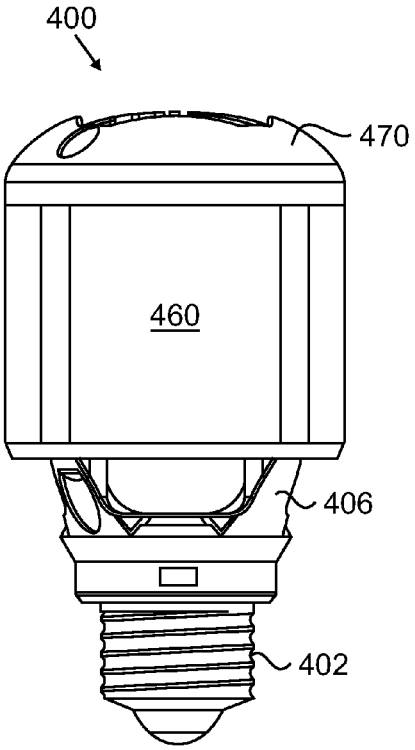
Figure 7C:
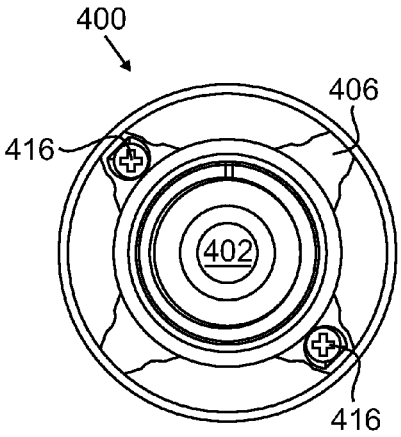
Figure 8A:
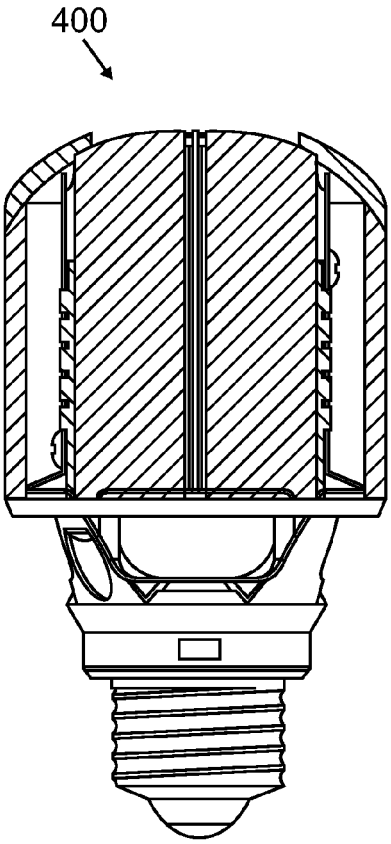
FIGS. 8A and 8B are cross-sectional views of the compact solid state lamp of FIG. 4 along section lines A-A and B-B of FIG. 7A, respectively.
Figure 8B:
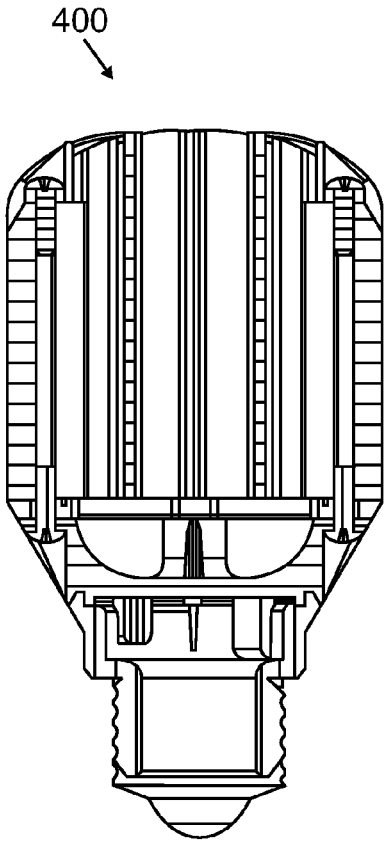

FIGS. 7A, 7B and 7C show top, side and bottom views of the lamp 400, and FIGS. 8A and 8B show cross-sectional views along lines A-A and B-B of FIG. 7A, respectively. FIG. 7A, LEDs 450 on top face 471 have a primary axis of light output X in a direction in which the LEDs on bottom face 473 direct no light, as their primary axis of light output Y is in the other direction.

Figure 9A:
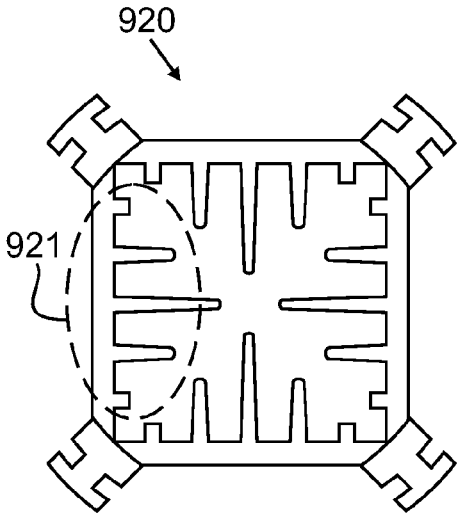
FIGS. 9A and 9B illustrate two alternative variations of heat sink fin configurations.
Figure 9B:
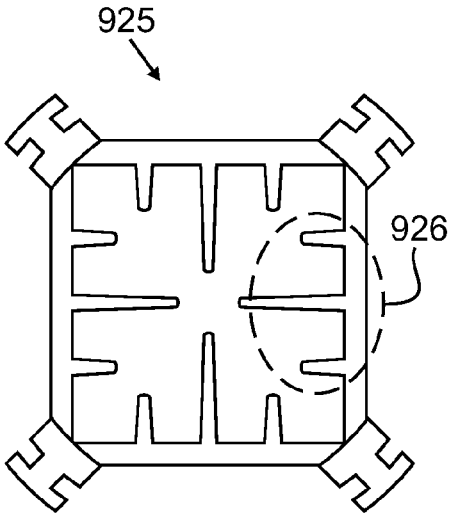
Figure 10:
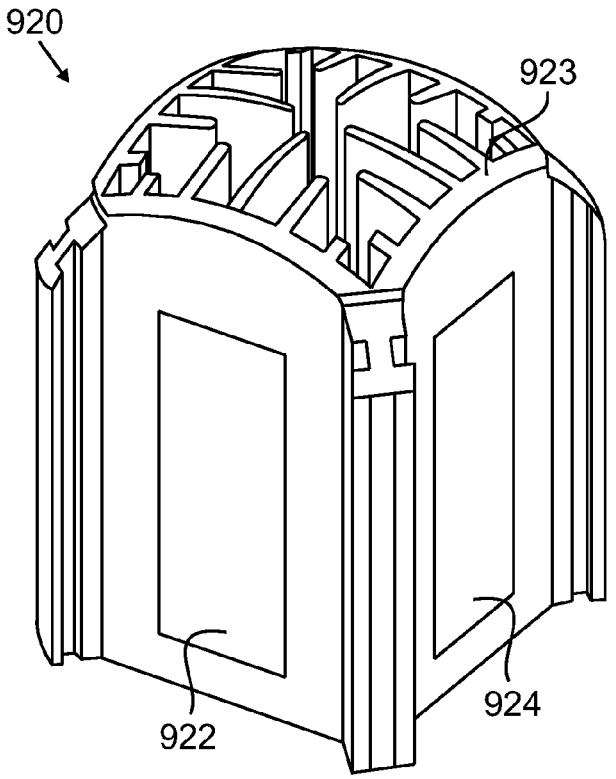
FIG. 10 is a perspective view of the fin configuration of FIG. 9A.

FIGS. 9A and 9B illustrate top views of two alternative heat sinks 920 and 925, respectively, with different fin arrangements. The heat sinks 920 and 925 may be manufactured in a number of ways, for example, cast or extruded aluminum, or injection molded or extruded thermally conductive plastic might be employed if less heat dissipation is needed. The material, location and number of fins may be selected based on the application and wattage to be dissipated. The examples shown include 3 fins 926 or 5 fins 921 per face, however, more or less fins may be used based upon the application. FIG. 10 shows a perspective view of the heat sink 920. In the perspective view of FIG. 10, the rectangular areas 922 simply indicate where LEDs would be mounted. The LEDs could be mounted as shown in FIG. 6 or using chip on heat sink mounting techniques, a multichip LED package, or standard LEDs soldered to a metal core printed circuit board (MCPCB), flex circuit or even a standard PCB, such as an FR4 board. For example, the LEDs could be mounted using substrate techniques such as from Thermastrate Ltd of Northumberland, UK. Top surfaces of heat sink 920, such as edges 923, may be machined or otherwise formed to match the dome shape of the standard A-lamp foot print to increase heat sink surface area.

Figure 11:
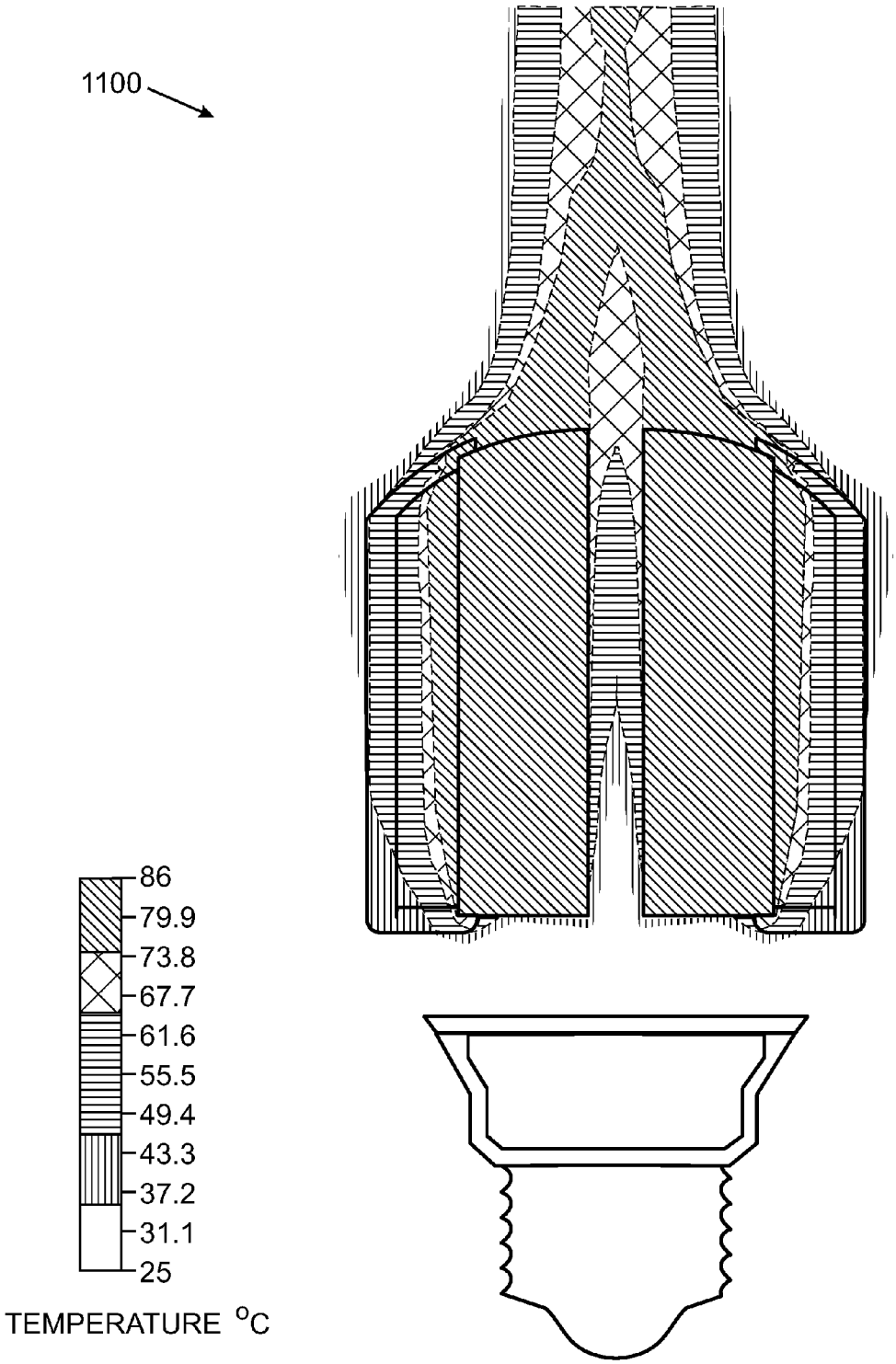
FIGS. 11 is a thermal plot for a simulation of a solid state lamp employing a heat sink in accordance with the present invention.

FIG. 11 shows a simulated thermal plot with a 9 W load, 2.25 W/face. The thermal plot demonstrates the functionality of the internal heat sink fins, keeping the heat sink change in temperature ($\Delta T$) from lamp off to steady state on to 50° to 60° C. for the 9 W load. This $\Delta T$ translates into a 60° to 75° C. rise in junction temperature. It should be noted that this simulation was run on a non-optimized tin structure like that shown in FIG. 9A, and improvements in geometry and performance should be expected as the design is optimized for specific applications/LED configurations.

Figure 12:
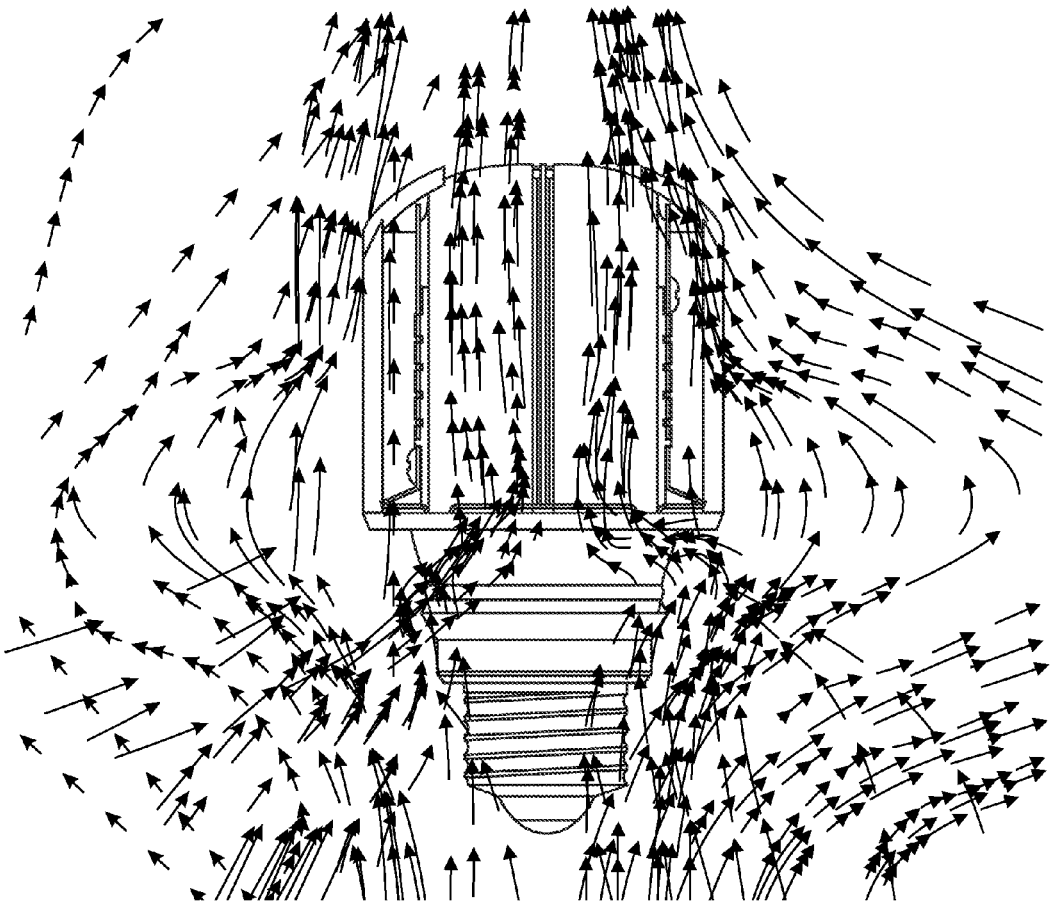
FIG. 12 is a flow-line plot for the simulation addressed by FIG. 11.

FIG. 12 shows a flow line plot 1100 from the same simulation as was addressed in connection with FIG. 11. The flow line plot 1100 demonstrates that the interior fin heat sink creates a chimney effect flow of air through the center of a lamp employing such a heat sink, like the lamp 400.

Figure 13:
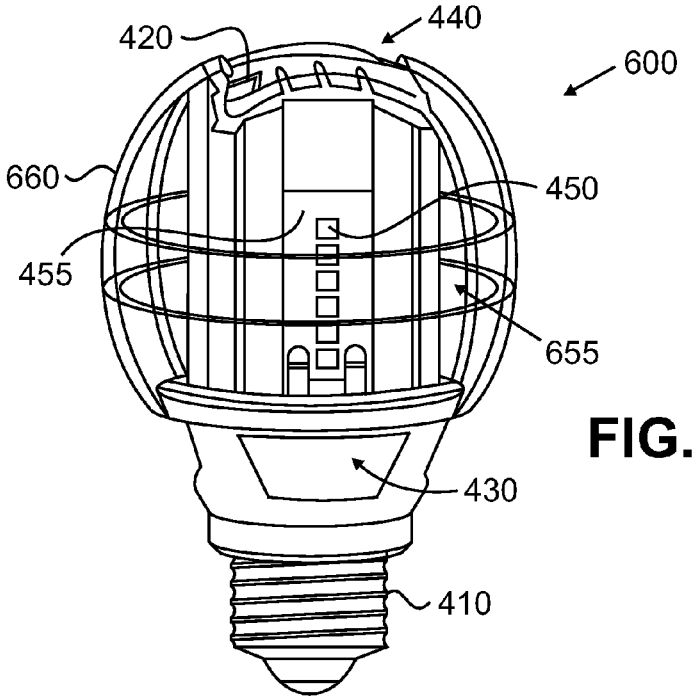
FIG. 13 is a perspective view of a solid state lamp according to some embodiments of the present invention.
Figure 14:
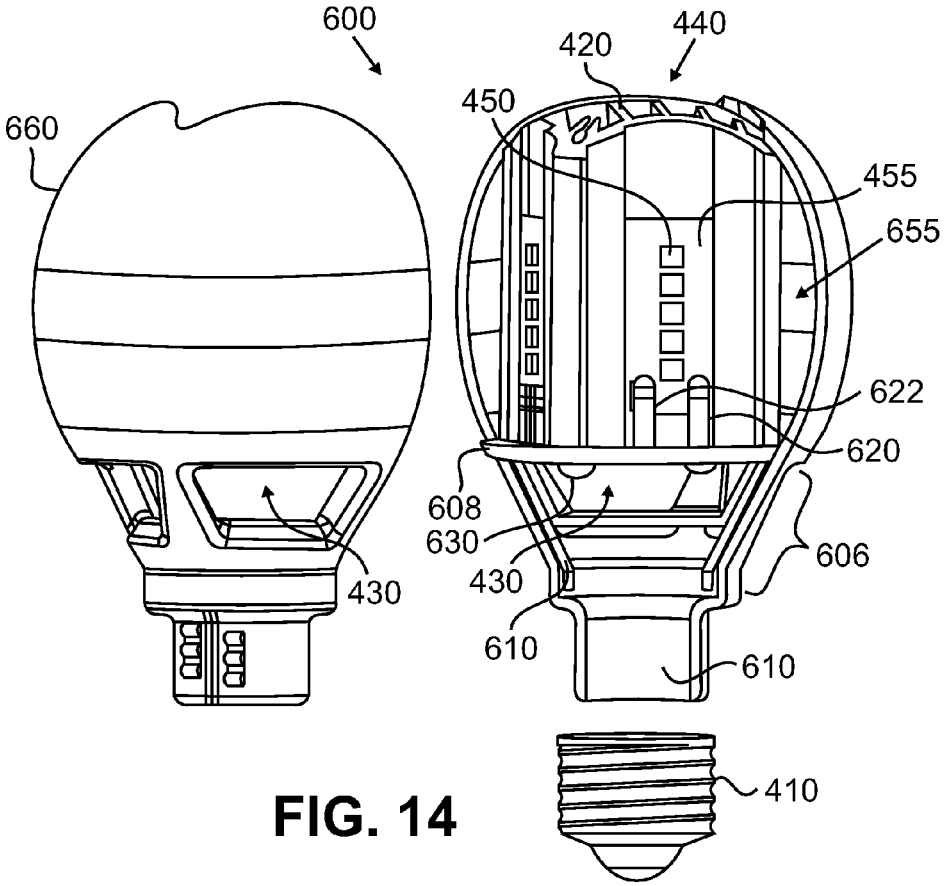
FIG. 14 is a cross-sectional view of the solid state lamp of FIG. 13.

FIGS. 13 and 14 illustrate a solid state lamp 600 according to further embodiments of the present inventive subject matter. As seen in FIGS. 13 and 14, the solid state lamp 600 includes the heat sink 420 and LED board 455 supporting LEDs 450 as described above. Optionally, the faces of the heat sink 420 on which the LED board 455 is mounted may be made flat to eliminate the angled portions at the corner of the heat sink 420 and allow light from different faces to be transmitted to portions of the lens 660 opposite a different face of the heat sink 420. The openings 420 and 430 allow for the flow of air through the heat sink 420. The solid state lamp 600, however, has an increase area of a mixing chamber 655 by providing a lens 660 that extends away from the LED board 450 while still fitting within the ANSI standard for the particular lamp, such as the A-lamp illustrated in FIGS. 13 and 14. By increasing the distance between the LEDs and the diffusive lens 660, the obscuration of the LEDs may be achieved with less diffusion and, therefore, less optical loss.

The lens 660 may be diffusive in that it may be made from a diffusing material or may include a diffuser film mounted on or near the lens 660. The lens 660 may be transmissive and reflective so that mixing occurs from a combination of reflection and refraction. The lens 660 may be thermo-formed, injection molded or otherwise shaped to provide the desired profile. Examples of suitable lens materials include diffusive materials from Bayer Material Science or SABIC. The lens 660 may be provided as a single structure or a composite of multiple structures. For example, the lens may be divided in half along a lateral line to allow insertion of the heat sink assembly into the lens and the second of "cap" portion of the lens attached. Furthermore, as illustrated in FIG. 14, the structure that provides the lens may also provide a housing 610 for the power supply as well as a stand 606 that spaces the heat sink 420 from the base to provide the openings 430.

The stand 606 may be made of one or more components. For example, as illustrated in FIG. 14, the stand 606 includes a base portion 608 on which the heat sink 420 is mounted. The stand 606 separates the heat sink 410 from the power supply housing 610 and may also provide electrical contacts 610 between the power supply (not shown) and the LED boards 450. As is further illustrated in FIG. 14, the base portion 608 may include friction connections 620 and 622 for electrically connecting to connector pads on the LED boards 450. The friction connections 620 and 622 may provide both electrical and mechanical connection of the heat sink assembly to the base portion 608. In such a way, the heat sink assembly including the heat sink 420 and the LED boards 450 may be assembled and tested and then inserted into the base portion without the need to solder electrical connections. The heat sink assembly may also be further fastened to the base portion 608 by additional mechanical fasteners, such as the screws 630 illustrated in FIG. 14.

While the heat sink 420, has been described herein as made as a single piece, such as a single extrusion, the heat sink may be made of multiple pieces. For example, each face could be an individual piece that is attached to other pieces to form the heat sink. Such an attachment may, for example, be provided by having mating surfaces of opposite polarity on each edge such that the mating surface of one face would slide into the mating surface of an adjacent face. Accordingly, the heat sink according to embodiments of the present inventive subject matter should not be construed as limited to a single unitized structure but may include heat sinks that are assembled from component parts.

Example

While not limited to the present example, a heat sink arrangement as illustrated in FIGS. 13 and 14 was produced from aluminum. The dimensions of the heat sink were as described above. Ten Cree XP LEDs (6 BSY and 4 red) from the R2 and M2 brightness bins were mounted on a MCPCB which was then mounted to the heat sink. A thermal grease was placed between the MCPCB and the heat sink to improve the thermal connection between the MCPCB and the heat sink. The lower section without a power supply was also constructed as part of the lenses.

The above described lamp was placed in the vertical orientation in a 25° C. ambient and driven with a remote power supply with 375 mA of current at 24.9 V initially and stabilized at 24.03 V after 40 minutes. The light output and electrical characteristics measured are summarized in Table 1 below.

TABLE 1

Prototype A lamp test results

| Time | Lumens | X | Y | CCT | CRI | Volts | Watts |
|---|---|---|---|---|---|---|---|
| 0 | 905.5 | 0.459 | 0.4126 | 2726 | 92.3 | 24.93 | 9.35 |
| 10 | 805 | 0.4773 | 0.4146 | 2914 | 92.6 | 24.18 | 9.07 |
| 20 | 782 | 0.4445 | 0.4152 | 2963 | 92.3 | 24.07 | 9.03 |
| 30 | 775.4 | 0.4432 | 0.4154 | 2917 | 92.1 | 24.04 | 9.02 |
| 40 | 773.5 | 0.4434 | 0.4155 | 2983 | 92.1 | 24.03 | 9.01 |
| 50 | 772.8 | 0.4436 | 0.4159 | 2987 | 92.1 | 24.03 | 9.01 |
| 60 | 776.6 | 0.4434 | 0.4156 | 2984 | 92.1 | 24.03 | 9.01 |

These test results suggest a junction temperature ($T_j$) of 77° C. with a measured temperature ($T_c$) on the heat sink of 70° C. at 9 W DC input power. It is estimated that $T_j$ goes up by 8-10° C. for the lamp in the horizontal position.

Embodiments of the present invention have been described with reference to a substantially square heat sink with four mounting faces. However, other configurations, such as triangular, pentagonal, octagonal or even circular could be provided. Furthermore, while the mounting surfaces are shown as flat, other shapes could be used. For example, the mounting surfaces could be convex or concave. Thus, a reference to a mounting face refers to location to and/or on which LEDs may be affixed and is not limited to a particular size or shape as the size and shape may vary, for example, depending on the LED configuration.

Furthermore, embodiments of the present invention have been illustrated as enclosed structures having openings only at opposing ends. However, the structure of the heat sink need not make a complete enclosure. In such a case, an enclosure could be made by other components of the lamp in combination with the heat sink or a portion of the lamp structure could be left open.

Additionally, the specific configuration of components, such as the lower housing, may be varied while still falling within the teachings of the present inventive subject matter. For example, the number of legs in the lower housing may be increased or decreased from the four legs show. Alternatively, the legs could be eliminated and a circular mesh or screen that allows air flow to the opening in the heat sink could be utilized. Similarly, the lower base 412 is shown as a disk with an opening corresponding to the heat sink opening, however, the lower base 412 may also include openings corresponding to the mixing cavity 455 to allow light extraction at the base of the lamp. A corresponding lens could be provided at the opening in the lower base. Alternatively, the lower base could be made from a transparent or translucent material and function as a lower lens for the lamp 400.

While the present invention has been disclosed in the context of various aspects of presently preferred embodiments including specific details relating to an A lamp replacement, it will be recognized that the invention may be suitably applied to other lamps including different dimensions, materials, LEDs, and the like consistent with the claims which follow.

In the drawings and specification, there have been disclosed typical embodiments of the present inventive subject matter and, although specific terms are employed, they are used in a generic and descriptive sense only and not for purposes of limitation, the scope of the present inventive subject matter being set forth in the following claims.

I claim:

1. A solid state lamp comprising:

a first portion;

a second portion;

at least one solid state light emitter; and at least a first arm and a second arm, the first portion comprising a heat sink, the heat sink comprising a plurality of mounting surfaces, the plurality of mounting surfaces defining an opening that extends through the heat sink, at least one of the mounting surfaces having at least one fin that extends into the opening, the second portion comprising an electrical contact, each of the first and second arms extending in a lengthwise direction from the second portion to the first portion and configured to allow air flow between the first portion and the second portion.

2. The solid state lamp according to claim 1, wherein the first arm is spaced from the second arm by a distance at least equal to a largest dimension of the second portion in a direction perpendicular to a line segment extending from the first portion to the second portion.

3. The solid state lamp according to claim 1, wherein the electrical contact comprises one of an Edison screw contact, a GU24 contact or a bayonet contact.

4. The solid state lamp according to claim 1 wherein the first portion has a form factor substantially corresponding to an A lamp.

5. The solid state lamp according to claim 1, wherein the lamp provides at least about 600 lumens while passively dissipating at least about 6 W of heat.

6. The solid state lamp according to claim 1, further comprising driver circuitry disposed within the second portion to provide a self-ballasted lamp.

7. A solid state lamp comprising:

at least a first solid state light emitter;

a heat sink, and a heat sink base, the heat sink comprising at least one heat sink portion, the at least one heat sink portion comprising at least a first inside surface and at least a first outside surface, at least a portion of the first outside surface opposite at least a portion of the first inside surface, the at least a first inside surface facing and defining a heat sink chamber that extends through an interior of at least a portion of the solid state lamp, the first solid state light emitter on the first outside surface, the solid state lamp configured such that ambient air can enter a region adjacent to the heat sink chamber from outside the lampthrough openings in an exterior surface of the lamp while moving in a direction substantially perpendicular to an axis of the solid state lamp, said axis a straight line with respect to which the solid state lamp is substantially structurally symmetrical, the heat sink base in contact with the heat sink, the heat sink base comprising at least a first base opening, said region adjacent to the heat sink chamber communicating with the heat sink chamber through at least the first base opening, the heat sink base comprising at least a second opening, the second opening for letting light through the base to enhance illumination configured such that light emitted by the first solid state light emitter can pass through the second opening.

8. A solid state lamp as recited in claim 7, wherein the solid state lamp is configured such that ambient air can (1) enter the heat sink chamber through openings while moving in a direction substantially perpendicular to an axis of the solid state lamp, and then (2) travel through at least a portion of the solid state lamp in the heat sink chamber while moving substantially parallel to the axis of the solid state lamp.

9. A solid state lamp as recited in claim 7, wherein the solid state lamp is an A 19 lamp.

10. A solid state lamp as recited in claim 7, wherein the solid state lamp fits within an A 19 envelope.

11. A solid state lamp as recited in claim 7, wherein the solid state lamp further comprises at least one lens.

12. A solid state lamp as recited in claim 7, wherein the solid state lamp further comprises a diffuser.

13. A solid state lamp as recited in claim 7, wherein the solid state lamp has a correlated color temperature of greater than 2500 K and less than 4500 K.

14. A solid state lamp as recited in claim 7, wherein the solid state lamp has a CRI Ra of at least 90.

15. A solid state lamp as recited in claim 7, wherein the solid state lamp has a lumen output of at least about 600 lumens.

16. A solid state lamp as recited in claim 7, wherein solid state the lamp has a light output of from about 0° to about 150° axially symmetric.

17. A solid state lamp as recited in claim 7, wherein the solid state lamp provides at least about 600 lumens while passively dissipating at least about 6 W of heat.

18. A solid state lamp comprising:

at least a first solid state light emitter;

a heat sink;

a first portion, a second portion, and at least first and second arms, the heat sink defining a heat sink chamber that extends through an interior of at least a portion of the solid state lamp, the solid state lamp configured such that ambient air can enter the heat sink chamber through openings while moving in a direction substantially perpendicular to an axis of the solid state lamp, the first solid state light emitter in the first portion, the second portion comprising an electrical contact, each of the first and second arms extending in a lengthwise direction from the second portion to the first portion, the first and second arms configured such that ambient air can enter the heat sink chamber through openings between the first and second arms while moving in a direction substantially perpendicular to an axis of the solid state lamp.

19. A solid state lamp as recited in claim 18, wherein the electrical contact comprises at least one of an Edison screw contact, a GU24 contact or a bayonet contact.

20. A solid state lamp as recited in claim 18, wherein the solid state lamp further comprises driver circuitry in the second portion to provide a self-ballasted lamp.

* * * * *